United States Patent [19]

Keum

[11] Patent Number: 4,996,751

[45] Date of Patent: Mar. 5, 1991

[54] AUTOMATIC EXPANDING AND RETRACTING DEVICE FOR BELT BUCKLE

[76] Inventor: Hak-Young Keum, 111-4, Yul-dong, Joongwon-Ku, Sungnam, Kyunggi Province, Rep. of Korea

[21] Appl. No.: 465,746

[22] Filed: Jan. 18, 1990

[30] Foreign Application Priority Data

Jul. 7, 1989 [KR] Rep. of Korea ..... 89-9954

[51] Int. Cl.[5] ..... A44B 11/00

[52] U.S. Cl. ..... 24/180; 24/181

[58] Field of Search ..... 24/180, 181, 190, 163 K, 24/265 WS, 71 J

[56] References Cited

U.S. PATENT DOCUMENTS

| | | | |
|---|---|---|---|
| 626,220 | 6/1899 | Comer | 24/181 |
| 1,619,138 | 3/1927 | Kollstede | 24/180 |
| 1,659,705 | 2/1928 | Roehr | 24/180 |
| 3,175,266 | 3/1965 | McMullen | 24/181 |
| 3,208,124 | 9/1965 | Rossi | 24/181 |
| 4,477,949 | 10/1984 | Calabro | 24/180 |

*Primary Examiner*—Victor N. Sakran

*Attorney, Agent, or Firm*—Finnegan, Henderson, Farabow, Garrett & Dunner

[57] ABSTRACT

An expanding and retracting belt buckle composed of a journal assembly connected to a spring disposed in the main body of the buckle. The main body contains a locking assembly to attach one end of the belt and also contains a pair of spaced parallel longitudinal tracks. The journal assembly has a cylindrical roller at each end which travels along the track in response to the urging of the spring. An outer plate is attached to the journal assembly for allowing longitudinal movement of the plate against the force of the spring. The opposite end of the plate has a projection for insertion into the other end of the belt.

5 Claims, 2 Drawing Sheets

AUTOMATIC EXPANDING AND RETRACTING DEVICE FOR BELT BUCKLE

This invention relates to an automatically expanding and retracting device for an ornamental belt buckle plate that will facilitate the tightening, expanding and releasing of any belt equipped with such a buckle.

Provided within the ornamental plate of the buckle is a sliding device which functions by means of a spring and provided at both ends of the sliding device are projections to allow the waist belt attached to the ornamental plate to either expand or tighten within a range of predetermined space providing constant comfort to anyone wearing a belt equipped with the herein described buckle regardless of change to one's waist measurement. For example: After one eats a large meal the buckle automatically expands the belt's fit as well as when one's waist size becomes smaller after digesting a meal, the buckle tightens the belt's fit. Another feature of this invention is directed to the ornamental plate comprised of a sliding device therein. By taking advantage of the self-regulating action of said sliding device which is attached to one end of the belt the need to readjust the catch inserted in a hole at the other end of the belt is eliminated with the catch remaining securely fastened in its original set position.

Conventional buckles without this expanding and tightening device cause an inconvenience to the wearer as the belt strap must be readjusted by manually moving the belt catch to and from different holes of the belt in order to accommodate the expansion of one's waist size resulting from having eaten a heavy meal or when one's physical posture changes.

Figure 1:
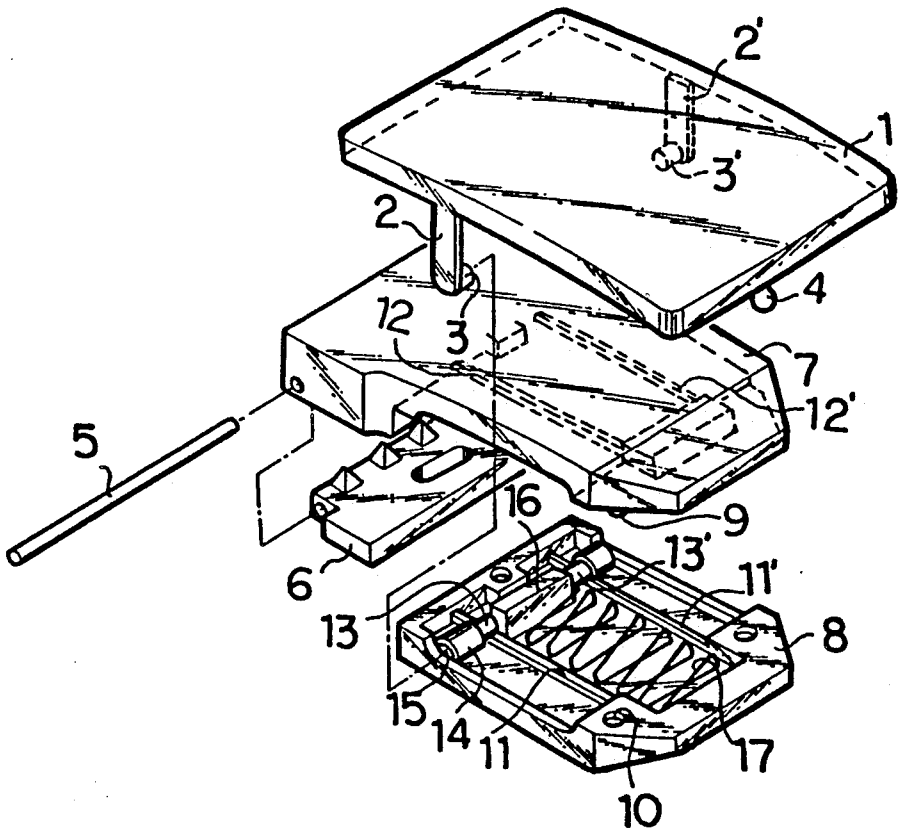
FIG. 1 is an exploded perspective view of the self-expanding and retracting device for a belt buckle in accordance with the present invention.
Figure 3:
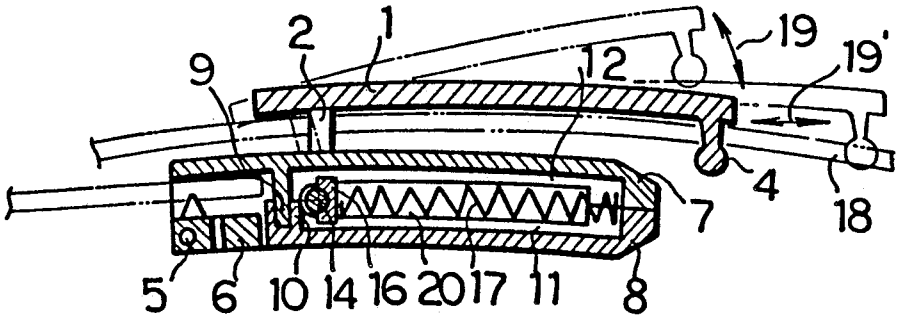
FIG. 3 is an enlarged sectional view of the present invention.
Figure 2:
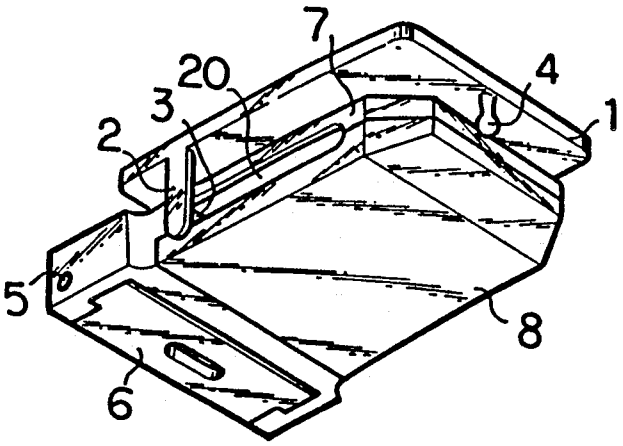
FIG. 2 is a bottom perspective view of the present invention in assembly state.

A detailed description of the present invention which eliminates the inconveniences of the conventional waist belt and buckle in accordance with the attached drawings is as follows:

At one side of the upper main body 7 is a locking plate 6 held together with a pin 5 provided to secure one end of the belt strap 18. In the middle, in order to enable the installation of the sliding device 14 with a spring 17 the upper main body 7 is furnished with the lower main body 8 by means of fixing projections 9 and fixing holes 10, the inside of which each of the lower guard rails 11, 11' and upper guard rails 12, 12' are furnished with a spring 17 and on the inserting holes 15 of the sliding device 14 are projections 3, 3' which are projecting within the vertical brackets 2, 2' thereby forming slide journals 13, 13' on the sliding device 14 in order to prevent detachment from the upper and lower guide rails 11, 11' and 12, 12' and to expand toward the direction of the arrow along the sliding slots 20 thereby forcing the rectangular portion 16 to retract the spring 17.

Spring 17 will automatically adjust the tension of the belt to a more comfortable fit when the waist line becomes reduced due to the digestion of a meal or when one stands up causing the tensile strength acting upon the waist to become reduced.

As mentioned above, the present invention will enable a belt to be adjusted automatically in proportion to the changes in the size of one's waist line and will provide a constant feeling of comfort to anyone wearing a belt equipped with said buckle.

Another feature of the present invention is to provide easy handling in connection with the original setting of the belt's position by providing catch 4.

In the middle of the sliding device 14 is a rectangular portion 16 formed to activate spring 17, and between the upper main body 7 and the lower main body 8 is a sliding slot to enable the movement of projections 3, 3'.

The arrow 19, 19' indicating the direction the belt slides through the belt buckle and the catch 4 are publicly known. Under the present invention a portion of the belt strap 18 is designed to be secured by the locking plate 6 held together by a pin 5 while the other portion will be squeezed between the ornamental plate 1 and the upper main body 7 with catch 4 extending past the lower level 8 and able to insert into the adjustment hole of the belt strap.

When one has eaten a heavy meal or when one sits in a chair there is an impact on the waist line. With this in mind the ornamental plate 1 which holds the belt and the upper main body 7 which secures the belt strap 18 will act against each other causing the projections 3, 3' on the ornamental plate 1 to adjust accordingly.

What is claimed is:

1. A belt buckle, comprising:

a main body having a chamber therein, said body having a pair of laterally spaced apart slots extending longitudinally along respective sides of the chamber, each of said slots having first and second ends;

a locking assembly mounted to one end of the main body for fixedly attaching one end of the belt to the main body;

a journal assembly movably disposed in the chamber and having opposite ends aligned with each of the respective slots;

spring means disposed in the chamber for engaging the journal assembly intermediate opposite ends thereof and for urging the journal assembly toward said first ends of said slots; and a plate member having a forward projection adjacent a first end and disposed forwardly of the main body and adapted for insertion into a hole in a belt, and a pair of rear projections adjacent a second end opposite to said first end of the plate, said rear projections being pivotably mounted to the respective ends of the journal assembly through respective longitudinally extending slots for allowing longitudinal movement of the plate and the journal assembly relative to the main body in response to a longitudinal force exerted by the belt.

2. The belt buckle of claim 1, wherein the main body includes spaced parallel tracks extending longitudinally along the length of the chamber for engaging the journal assembly.

3. The belt buckle of claim 2, wherein the journal assembly includes a pair of spaced cylindrical rollers disposed in the said spaced parallel tracks for allowing movement of the journal assembly along the length of the chamber.

4. The belt buckle of claim 3, wherein each cylindrical roller includes an inserting hole for receiving the respective rear projections of the plate member.

5. The belt buckle of claim 1, wherein the forward projection of the plate member includes a spherical portion of increased diameter adapted for securing the projection in the hole of the belt.

* * * * *